US005323963A

United States Patent [19]

Ballu

[11] Patent Number: 5,323,963

[45] Date of Patent: Jun. 28, 1994

[54] NOZZLE FOR SPRAYING LIQUID INCLUDING A DEFORMABLE OUTLET ORIFICE

[75] Inventor: Patrick Ballu, Reims, France

[73] Assignee: Tecnoma, Epernay, France

[21] Appl. No.: 15,517

[22] Filed: Feb. 9, 1993

[30] Foreign Application Priority Data

Feb. 14, 1992 [FR] France ..... 92 01685

[51] Int. Cl.[5] ..... B05B 1/12; B05B 12/08

[52] U.S. Cl. ..... 239/63; 239/68; 239/464; 239/476; 239/546; 239/DIG. 12

[58] Field of Search ..... 239/63, 68, 463, 464, 239/476, 489, 490, 533.13, 546, DIG. 12, DIG. 19

[56] References Cited

U.S. PATENT DOCUMENTS

| | | | |
|---|---|---|---|
| 208,330 | 9/1878 | Palmer | 239/546 |
| 2,300,679 | 11/1942 | Klein | 239/546 X |
| 2,959,359 | 11/1960 | Casaletto . | |
| 2,998,198 | 8/1961 | Young | 239/546 X |
| 3,612,409 | 10/1971 | Henning | 239/DIG. 19 X |
| 3,776,470 | 12/1973 | Tsuchiya . | |
| 3,930,619 | 1/1976 | Levey et al. | 239/533.13 X |
| 4,232,828 | 11/1980 | Shelly, Jr. | 239/546 X |
| 4,595,344 | 6/1986 | Briley | 239/546 X |
| 4,789,104 | 12/1988 | Anderson | 239/546 X |
| 4,793,144 | 12/1988 | Bidon et al. . | |
| 4,922,852 | 5/1990 | Price | 239/63 X |
| 4,930,441 | 6/1990 | Tolmie, Jr. | 239/63 X |
| 4,986,477 | 1/1991 | Roman | 239/546 X |

FOREIGN PATENT DOCUMENTS

| | | | |
|---|---|---|---|
| 0202847 | 11/1986 | European Pat. Off. | 239/63 |
| 373341 | 6/1990 | European Pat. Off. . | |
| 17430 | 3/1882 | Fed. Rep. of Germany . | |
| 2439226 | 2/1976 | Fed. Rep. of Germany . | |
| 2618087 | 1/1989 | France . | |
| 0902769 | 2/1982 | U.S.S.R. | 239/533.13 |
| 951589 | 3/1964 | United Kingdom . | |
| 8912510 | 12/1989 | World Int. Prop. O. | 239/63 |

OTHER PUBLICATIONS

Machine Design No. 37, Jul. 22, 1965, p. 147 'expandable cone forms variable orifice'.

*Primary Examiner*—Andres Kashnikow
*Assistant Examiner*—William Grant
*Attorney, Agent, or Firm*—Watson, Cole, Grindle & Watson

[57] ABSTRACT

A nozzle for spraying liquids includes a body pierced with a bore, preferably a cylindrical or cylindro-conical bore, and carrying an endpiece pierced with an orifice which may be frustoconical flowing out towards the outside or dihedral opening out towards the outside, this orifice being coaxial with a preferably hemispherical swirl chamber and opening out into the latter via a narrow passage. The endpiece is made from an elastically deformable material, and a restraining component, carried by the body and able to move with respect to the endpiece, acts on the endpiece in order to adjust the cross-section and/or the shape of the the orifice without substantially deforming the swirl chamber.

10 Claims, 2 Drawing Sheets

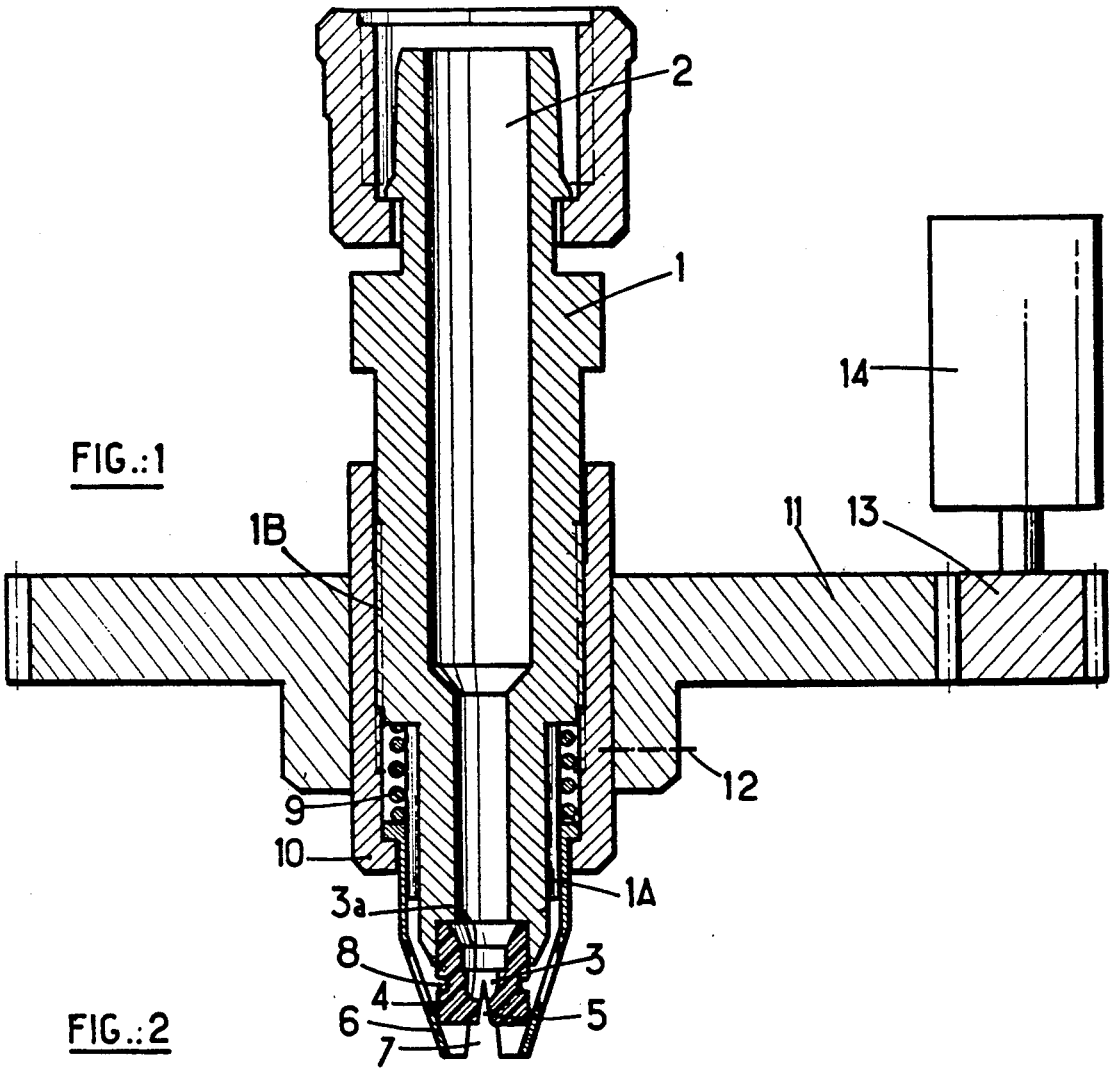
FIG.:1
FIG.:2
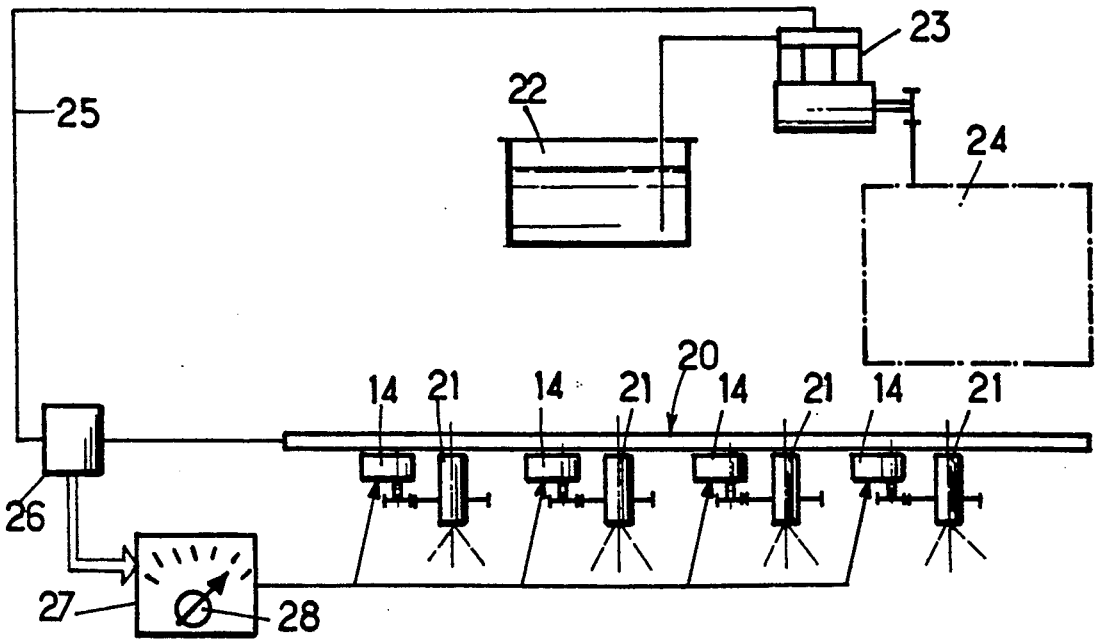

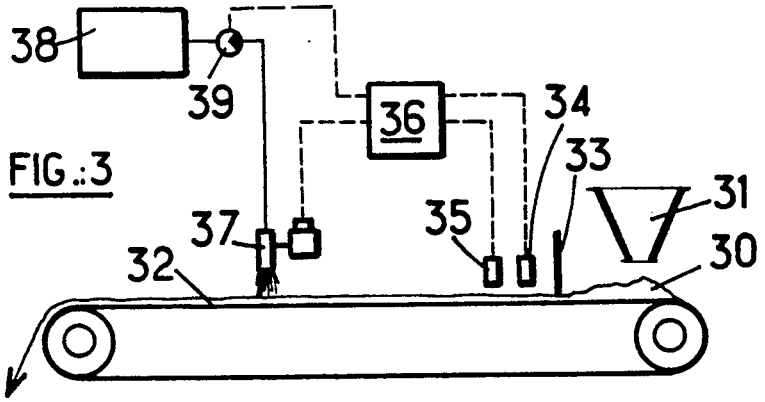
FIG.:3
FIG.:4
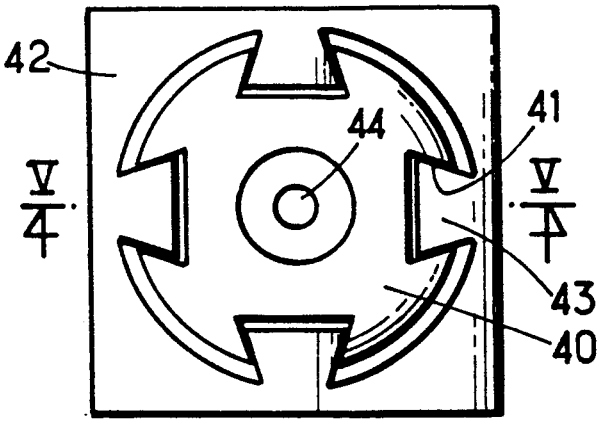
FIG.:6
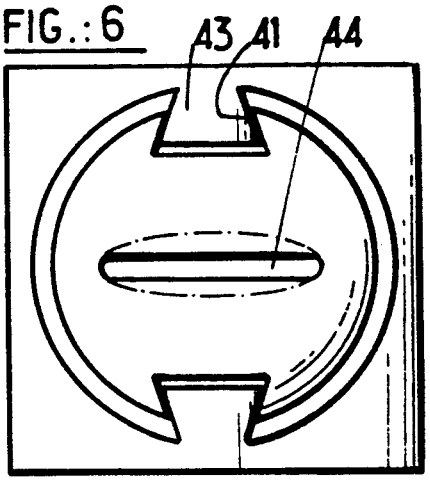
FIG.:5
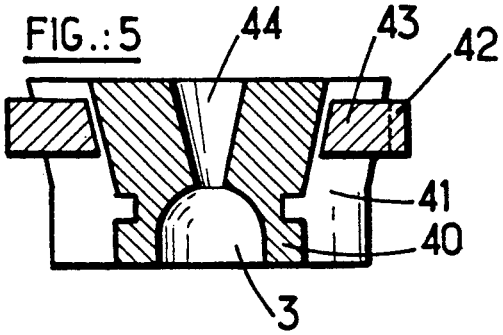

NOZZLE FOR SPRAYING LIQUID INCLUDING A DEFORMABLE OUTLET ORIFICE

BACKGROUND OF THE INVENTION

The present invention relates to a nozzle for spraying liquid.

A nozzle for spraying liquid is generally a component comprising a hollow inside, called a swirl chamber, connected on one side to a feed source, and whose wall opposite the inlet is generally of hemispherical shape. An outlet orifice opens out into the generally hemispherical shaped end wall of the swirl chamber, which outlet orifice has, at the point where it opens out into the swirl chamber, a much smaller cross-section, not more than half, and preferably less than one fifth, of the transverse section of the swirl chamber. In general, the outlet orifice widens towards the outside moving away from the swirl chamber, but this is not obligatory.

By virtue of this particular shape, the liquid passing through the nozzle, subjected to an abrupt succession of compression and depression, bursts out into multiple droplets. The outlet orifice may have a circular cross-section or a flattened cross-section, depending on the shape of the jet of droplets which it is desired to obtain.

Spray nozzles which have the object of giving greater speed to a jet of liquid, without, however, causing it to burst out into droplets, have a distinctly different shape, with progressive narrowing, possibly followed by a widening which is also progressive. The progressiveness of the variations in cross-section leads to an increase in the velocity of the jet without the dispersion of the latter.

The size of the droplets formed at the outlet of a spray nozzle of given dimensions and shape depends, inter alia, on the pressure of the liquid in the swirl chamber.

With conventional spray nozzles, for a given nozzle and liquid, there is a correlation between the flowrate of the liquid and the pressure of the latter, and therefore the size of the droplets. In numerous technological fields, it would be desirable to be able to vary these parameters independently of one another. For example, it may be desirable to vary the flowrate whilst keeping the size of the droplets constant. This is the case, for example, in agricultural technology, where the size of the droplets determines the effectiveness of treatments with phyto-sanitary products, but in which the quantity of products laid down by unit surface area must remain constant, which implies that the flowrate of the nozzle must be adjusted to the speed of displacement of the carrying vehicle. It is also the case in many other technological fields, for example the moistening of paper or cloth as a function of their water content inside a processing machine. In other cases, it may be desirable to vary the size of the droplets, for example in order to modify their cooling effect, without being obliged simultaneously to modify the flowrate.

It would be desirable to be able to have use of a nozzle which allows action on the size of the droplets and the flowrate of liquid, independently of one another.

Of course, such a nozzle must be inexpensive, robust and easy to maintain.

Proposals have been made, see for example UK Patent No 951,589, German Patent No 17430, U.S. Pat. No. 3,776,470, for devices allowing the shape, and consequently the performance of nozzles for spraying jets of liquid to be modified, but nothing has been written or suggested for applying similar techniques to spray nozzles. The reason for this is doubtless that it is more difficult to deform a component containing a swirl chamber with a hemispherical wall, followed by a narrow passage orifice, than a conventional jet spray nozzle. Indeed, a conventional jet spraying nozzle may be made from a component with a thin wall, which is easy to deform. In contrast, a spray nozzle necessarily consists of a solid component, in which the spray chamber and the outlet orifice are hollowed, and it doubtless seemed impossible at the time to deform such a component in a controlled fashion.

In German Patent Application No 2,439,226, a spray nozzle was proposed whose end is composed of a block of elastic material, inside which the swirl chamber and outlet orifice are hollowed. The object of this arrangement is not to modify the shape of the nozzle at will, but to allow, by deformation of the orifice, the escape of a foreign solid which would come to block the nozzle, the latter then resuming its habitual shape.

SUMMARY OF THE INVENTION

The object of the invention is to provide a nozzle for spraying liquid in which it is possible to vary, at will, within certain limits, the performance, that is to say the size of the droplets for a given flowrate, or conversely, the flowrate without modifying the size of the droplets.

In order to obtain this result, the invention provides a liquid spraying nozzle, comprising a body having an internal cavity and carrying an endpiece composed of a solid component made from an elastically deformable material, this component having a swirl chamber, connected to the internal cavity of the body, and an axial outlet orifice, opening out into the swirl chamber via a passage of cross-section which is at most equal to half that of the swirl chamber, characterised in that a mobile restraining component is provided, whose displacement acts in order to deform the endpiece, and in that means are provided for preventing the displacement of the restricting component from substantially deforming the swirl chamber.

According to a simple embodiment, in order to prevent the deformation of the swirl chamber, the restraining component is displaced substantially transversely by acting on the part of the endpiece which contains the outlet orifice.

This embodiment has the advantage of its simplicity, when it is applied to a spray nozzle whose outlet orifice has a flattened cross-section: however, even in this case it has the drawback of modifying the shape of the outlet orifice.

According to a more complicated but more generally applicable embodiment, the restraining component is frustoconical and moves axially acting on the outlet end of the endpiece, and the latter has a peripheral groove in the vicinity of the level of the passage connecting the swirl chamber to the outlet orifice, this groove being of calculated shape and dimensions so that the deformation imposed by the restraining component is not substantially transmitted to the swirl chamber.

The use of a deformable nozzle brings adjustment possibilities which have not been made use of up until now, and makes it possible to reach the desired goal, for example by increasing the cross-section of the orifice when the flowrate is to be increased, or by decreasing it when it must be reduced, the pressure upstream of the endpiece remaining substantially constant, or even by varying, in the opposite direction, the feed pressure and the cross-section of the orifice in order to vary the size of the droplets at constant flowrate, or even by causing the flowrate, the pressure and the cross-section of the orifice to vary according to another pre-established law, as a function of the desired result.

In a simpler fashion, the restraining component is a hollow component, comprising an outwardly converging internal surface which may be displaced axially in order to exert a radial compression force on the endpiece tending to reduce the cross-section of the orifice, a displacement of the restraining component in the opposite direction releasing the compression force, which tends to widen the orifice up to the dimension which it has at rest.

It may, however, be advantageous to make provision for the restraining component to come into engagement with the endpiece and to be able to exert on the endpiece, when it moves, a radial traction force tending to increase the cross-section of the orifice.

Advantageously, if the orifice has a circular cross-section at rest, the internal surface of the restraining component has a shape of revolution. It may also have an oval cross-section, so as to modify the shape of the orifice, and thus of the jet of droplets which it produces. If the orifice is slit shaped, the part of the internal surface of the restraining component which interacts with the endpiece is flattened in transverse section.

According to one mode which may be combined with the previous one, the restraining component may slide axially along the body by being rotationally immobilised, and a micrometer screw device produces its sliding displacement.

According to an advantageous embodiment, a pressure sensor arranged in the feed circuit of the device is connected to a control member able to control the displacements of the restraining component in response to the signals from the pressure sensor.

BRIEF-DESCRIPTION OF THE DRAWINGS

The invention will be explained in a more detailed fashion with the aid of practical examples illustrated with the aid of the figures, amongst which:

FIG. 1 is an axial section of a nozzle in accordance with the invention.

FIG. 2 is an overall diagram of a spraying installation comprising nozzles in accordance with the invention.

FIG. 3 is a diagram of another installation in accordance with the invention.

FIG. 4 is a view, taken along the axis, of a variant of the endpiece of FIG. 1.

FIG. 5 is a section along the line V—V of FIG. 4.

FIG. 6 shows another embodiment of the endpiece of FIG. 4.

DETAILED DESCRIPTION OF THE PREFERRED EMBODIMENTS

The nozzle comprises a body 1 which has an axial passage 2 for the liquid. At one of its ends, it is provided with means for connection to an inlet hose.

The axial passage 2 ends, at the opposite end, in a swirl chamber 3 of hemispherical shape, provided in an endpiece 4 securely fastened to the body 1, and manufactured from a different material which allows a deformation of this endpiece at the level of the outlet cross-section.

It will be noted that as a variant, the endpiece 4 may also be made as a single component with the body 1, the deformability then results solely from the shape and the thickness of the endpiece.

The endpiece has a slit-shaped orifice 5 at its end, and more precisely a dihedral orifice opening towards the outside, the orifice 5 opens out, at its end opposite the outside, into the swirl chamber 3, the swirl chamber, being of hemispherical shape, providing a front wall 3*a* which is substantially perpendicular to the orifice 5. The elastomer from which the endpiece 4 is manufactured gives it a flexibility from the deformation point of view, allowing a variation to be obtained in the liquid passage cross-section, and ensures that it resumes its initial shape (position in which the endpiece 4 undergoes practically no deformation).

A restraining component 6 is imparted with a translational movement with respect to the body 1 and the endpiece 4 without possible rotation by virtue of two bosses and grooves 1A. This makes it possible to keep the slit 5 and a slit 7 of the restraining component 6 in alignment, and consequently to keep the possible passage of the jet aligned when the nozzle is under pressure.

A peripheral groove 8 is hollowed out of the outer surface of the endpiece 4 in the vicinity of a plane perpendicular to the axis which passes through the zone in which the orifice 5 opens out into the swirl chamber. The shape and position of the groove 8 are such that deformation of the endpiece 4 resulting from a displacement of the restraining component occurs essentially in the part of the endpiece which is situated between the groove 8 and the end of the endpiece, and such that the swirl chamber is not deformed.

The shape of the restraining component 6 may vary according, especially, to the shape of the endpiece 4 and of its orifice 5. The part of the component 6 which slides on the body 1 has a shape which is matched to the latter, and is therefore generally cylindrical. The part which interacts with the endpiece may have an internal surface of elliptical cross-section which is flattened to a greater or lesser extent, or may well have a circular cross-section. The nozzle 4, in each case, will have a matched shape in order substantially to preserve the flattened shape of the jet of droplets which results from the elongate shape of the orifice 5. In the case in which the orifice 5 has a circular cross-section it is clear that the restraining component will advantageously have a shape of revolution.

A spring 9, mounted between the body 1 and the conical component 6, exerts on the latter an axial force tending to push it back. This spring thus prevents the accidentally brought about translation of the component 6, which would instantaneously modify the pressure at the level of a nozzle.

In contrast, the desired movement on this component will be obtained precisely by means of a nut 10. Indeed, this nut is imparted with a rotational and translational movement provided by a micrometer thread 1B between the nut and the body 1. This nut is securely fastened to a pinion 11 by means of a screw 12.

The function of the pinion 11 is to provide the rotation of the nut and to produce the adjustment necessary for setting the pressure.

The rotation of the gear 11 is itself provided by another pinion 13 driven by a motor 14.

The motor is advantageously, but not necessarily, an electric stepper motor, in the case of an automated or remote control. In a simpler embodiment, it may be replaced by a manual control, with means for identifying the angular position of the pinion 11.

FIG. 2 diagrammatically shows an installation equipped with nozzles according to the invention and intended to supply droplets of constant dimensions from a volumetric pump whose flowrate may vary. Typically, such a problem is presented in the treating of vegetation with the aid of phyto-sanitary products, when the installation is carried by a vehicle which may have a variable speed, the flowrate of the pump varying with the speed of the vehicle in order to spray a constant quantity of product per unit surface area. However, the diagram of FIG. 2 is suitable for installations of many other technical fields by means of adaptations which are within the competence of the person skilled in the art.

A boom 20 carries a series of nozzles 21 in accordance with the invention, each equipped with a motor 14. The feed circuit of the boom 20 comprises a tank of product to be sprayed 22, a pump 23, whose useful flowrate is adjusted by a control system 24, itself controlled by the displacement of the carrying vehicle. A pipe 25 connects the spray pump 23 to the boom 20. A pressure sensor 26, interposed on the pipe 25, measures the pressure in the circuit.

It will be noted that the reference 26 may denote, instead of a pressure sensor, a flowrate sensor, or even an assembly formed by a pressure sensor and a flowrate sensor.

The sensor 26 is connected to a control box 27 in which the measured value is recorded, which is that of the pressure in the example described here. The face of the box is equipped with a button 28 with which the desired working value is displayed. If the measured value is greater than the desired working value, the difference between these two values is compensated by virtue of electronics which, by means of pulses, act on the motor 14, which is a stepper motor. The motor, revolving by steps, then acts on the conical endpiece with greater precision, and thus allows the endpiece 4 to open, thus obtaining an adjustment of the measured value with respect to the desired value.

Likewise, if the measured value is lower than the desired working pressure, the difference will be compensated so as to act on the restraining component 6, which will close the endpiece 4 a little more whence a value automatically adjusted to the desired value.

In the example described, an increase or decrease in pressure is the consequence of a variation in the speed of forward travel of the appliance. A volumetric system at constant pressure is thus ensured, regardless of this speed of forward travel, or a pressure obeying any other law chosen as a function of this speed.

If the sensor 26 is a flowrate sensor, or a set of sensors for flowrate and pressure, the abovementioned operational description remains valid provided that pressure is replaced in this description by flowrate or by a function of the pressure-flowrate pairing chosen in advance.

When it is sought, in the example described, to obtain droplets of constant size, it may be equipped, possibly by means of a remote control, in order to vary the size of the drops at will. It is known that, for example, when it is desired to form a mist, it is advantageous to be able to vary, according to the circumstances, the size of the droplets produced. In this case, the installation may also be represented by the diagram of FIG. 2, provided that the reference 23 denotes a pumping system with a stabilised outlet pressure, and the reference 26 denotes a flowrate sensor.

FIG. 3 shows another diagram of an installation, intended to supply a machine with a product whose wetness must be continuously adjusted to a determined value.

The product to be processed 30 is poured into a hopper 31 on a conveyor belt 32. An equalising device 33 brings the layer of product on the belt 32 to a constant thickness.

A gamma ray probe 34 determines the wetness factor of the arriving product. A temperature probe 35 likewise determines the temperature of the product. The signals from the probes 34 and 35 are sent to a computer 6. An adjustable nozzle 37 in accordance with the invention is connected to a water tank 38 via a pump 39. The computer 36 permanently controls the pump 39 and the nozzle 37 in order permanently to adjust both the flowrate of the water and the size of the droplets as a function of the wetness and of the temperature of the product, the droplets being larger if the product is hotter. The probes 34 and 35 may also be placed after the nozzle, in the direction of forward travel of the product.

In the example which has been described, the opening and closing of the orifice is done solely by elasticity, a displacement of the moving component 6 so as to bring it out of contact with the endpiece 4 ends in the maximum opening of the slit. It is, however, possible to make provision for the moveable component to be able to widen, still in an elastic fashion, the dimensions of the orifice.

In accordance with the variant of FIGS. 4 and 5, the endpiece 40, made from an elastic material, has longitudinal grooves 41 of dove-tailed cross-section, which converge towards the axis. A rigid restraining component 42, which may slide axially around the endpiece 41, comprises longitudinal dove-tail ribs 43 projecting radially towards the axis and which penetrate into the grooves 41. It is designed for a longitudinal displacement of the component 42 to increase the cross-section of the orifice 44 of the endpiece with respect to the cross-section which it has at rest.

The words "dove tail" must here be understood in the broadest sense, they apply to any groove whose bottom is wider than the opening, and to any rib of matched shape.

FIG. 6, analogous to FIG. 4, corresponds to an arrangement in which the orifice 44 of the endpiece is in the form of a slit instead of being of circular cross-section. Only two dove-tail grooves 41 are provided, diametrically opposed in the direction perpendicular to the extension of the slit 44, and two corresponding ribs 43. The ribs 43 tend, moving apart, to widen the slit thereby giving it the shape represented in chain lines.

It may be observed that the grooves 41 may also be placed in the direction of the extension of the slit 44. In this case, the spacing of the ribs tends to close the slit.

It will be understood that the ribs may be carried by the endpiece and the grooves provided in the restraining component, without this changing the operation.

The solution of FIGS. 4 to 6 causes the material of the endpiece 40 to work by deformation on either side of a rest position, whence lower fatigue than in the case of FIG. 1. In contrast, the machining is more costly. The choice between the solutions is therefore essentially a question of cost.

I claim:

1. A liquid spraying nozzle, comprising a body having an internal cavity and carrying an endpiece composed of a solid component made from an elastically deformable material, this component having a swirl chamber connected to the internal cavity of the body and an axial outlet orifice opening into a front wall of the swirl chamber via a passage of cross-section which is at most equal to half that of the swirl chamber, said front wall of said swirl chamber extending substantially perpendicularly to said outlet orifice; a mobile restraining component whose displacement acts to deform the endpiece and modify the cross-section of said outlet orifice; and means for preventing displacement of the restraining component from substantially deforming the swirl chamber.

2. The nozzle of claim 1, wherein the restraining component is frustoconical and can move axially to act on an outlet end of the endpiece, and wherein said means for preventing displacement of said restraining component from substantially deforming the swirl chamber comprises a peripheral groove in the endpiece in the vicinity of the level of the passage connecting the swirl chamber to the outlet orifice.

3. The nozzle of claim 2, wherein the orifice is of circular cross-section at rest, and wherein the restraining component has an internal surface which has a shape of revolution.

4. The nozzle of claim 2, wherein the orifice has a circular cross-section at rest, and wherein the restraining component has an internal surface of oval cross-section.

5. The nozzle of claim 2, wherein the orifice is slit shaped, and wherein the restraining component has an internal surface part which interacts with the endpiece and is flattened in transverse section.

6. The nozzle of claim 1, wherein the restraining component engages the endpiece and when moved is able to exert on the endpiece a radial traction force tending to increase the cross-section of the orifice.

7. The nozzle of claim 1, wherein the restraining component is axially and non-rotationally moveable along the body, and including a micrometer screw device connected to said restraining component for moving said restraining component.

8. A spraying apparatus which comprises:

a liquid spraying nozzle, said liquid spraying nozzle comprising a body having an internal cavity and carrying an endpiece composed of a solid component made from an elastically deformable material, this component having a swirl chamber connected to the internal cavity of the body and an axial outlet orifice opening into a front wall of the swirl chamber via a passage of cross-section which is at most equal to half that of the swirl chamber, said front wall of said swirl chamber extending substantially perpendicularly to said outlet orifice; a mobile restraining component whose displacement acts to deform the endpiece and modify the cross-section of said outlet orifice; and means for preventing displacement of the restraining component from substantially deforming the swirl chamber, a feed circuit for supplying liquid to the internal cavity of the body of said liquid spraying nozzle, a pressure sensor located in said feed circuit, and electronic control means for controlling movement of said mobile restraining component based on signals received from said pressure sensor.

9. A spraying apparatus which comprises:

a liquid spraying nozzle, said spraying nozzle comprising a body having an internal cavity and carrying an endpiece composed of a solid component made from an elastically deformable material this component having a swirl chamber connected to the internal cavity of the body and an axial outlet orifice opening into a front wall of the swirl chamber via a passage of cross-section which is at most equal to half that of the swirl chamber, said front wall of said swirl chamber extending substantially perpendicularly to said outlet orifice; a mobile restraining component whose displacement acts to deform the endpiece and modify the cross-section of said outlet of orifice; and means for preventing displacement of the restraining component from substantially deforming the swirl chamber, a feed circuit for supplying liquid to the internal cavity of the body of said liquid spraying nozzle, a flowrate sensor located in said feed circuit, and electronic control means for controlling movement of said mobile restraining component based on signals received from said flowrate sensor.

10. A spraying apparatus for adjusting the wetness of a product, said spraying apparatus comprising:

a liquid spraying nozzle, said spraying nozzle comprising a body having an internal cavity and carrying an endpiece composed of a solid component made from an elastically deformable material this component having a swirl chamber connected to the internal cavity of the body and an axial outlet orifice opening into a front wall of the swirl chamber via a passage of cross-section which is at most equal to half that of the swirl chamber, said front wall of said swirl chamber extending substantially perpendicularly to said outlet orifice; a mobile restraining component whose displacement acts to deform the endpiece and modify the cross-section of said outlet orifice; and means for preventing displacement of the restraining component from substantially deforming the swirl chamber, a feed circuit for supplying liquid to the internal cavity of the body of said liquid spraying nozzle, a wetness sensor for sensing the wetness of a product, and electronic control means for controlling movement of said mobile restraining component based on signals received from said wetness sensor.

* * * * *